United States Patent [19]

Lipinski

[11] 3,971,395

[45] July 27, 1976

[54] COLLAPSIBLE SELF-STORING SHELTER

[76] Inventor: Vincent B. Lipinski, P.O. Box 41, Chaska, Minn. 55318

[22] Filed: Dec. 16, 1974

[21] Appl. No.: 533,319

[52] U.S. Cl. ..... 135/4 R; 9/8 R; 135/1 R; 280/12 S

[51] Int. Cl.[2] ..... E04B 1/347; A45F 1/16

[58] Field of Search ..... 135/1 R, 3 R, 4 R, 5 B, 135/5 E; 296/23 G; 280/12 S; 46/12; 5/113; 160/135, 351

[56] References Cited

UNITED STATES PATENTS

| | | | |
|---|---|---|---|
| 2,301,089 | 11/1942 | Stevens | 135/3 R |
| 2,473,076 | 6/1949 | Scheibner | 135/4 R |
| 2,546,588 | 3/1951 | Ellis | 135/4 R |
| 2,546,730 | 3/1951 | Dickerson | 135/4 R |
| 2,804,083 | 8/1957 | Wieber | 135/4 R |
| 2,855,037 | 10/1958 | Stiffel | 160/135 |
| 2,891,562 | 6/1959 | Kruczynski | 135/1 R |
| 3,052,249 | 9/1962 | Seaman et al. | 135/1 R |
| 3,175,857 | 3/1965 | Lewis | 135/4 A |
| 3,352,313 | 11/1967 | Kroening | 135/1 R |
| 3,538,976 | 10/1970 | Gilbert et al. | 160/135 |

*Primary Examiner*—Werner H. Schroeder
*Assistant Examiner*—Conrad L. Berman
*Attorney, Agent, or Firm*—Williamson, Bains & Moore

[57] ABSTRACT

A compact, lightweight, self-storing, collapsible shelter for all-season recreational use has a rigid floor platform to which front and rear walls are swingably mounted for rotation about parallel axes, each of the walls being swingable between upright wall-defining positions and lowered storage positions wherein the rear wall closely overlies and confronts the floor platform, and the front wall overlies and confronts the lowered rear wall. The axis about which the front wall swings is positioned at a greater distance above the platform than the axis about which the rear wall swings so that the front wall will swing to a position closely overlying the rear wall to provide the cover for the collapsed shelter. A plurality of removable longitudinal beams extends between the upright front and rear walls to prevent swinging of the walls toward one another and store within the shelter when it is collapsed; a plurality of cords extends between the platform and front and rear walls to further retain the walls in upright positions. A weather-resistant canvas tarpaulin extends between and is fixed to the front and rear walls and also to the platform to define an integral roof and side walls for the shelter. A pair of skis facilitates transportation of the shelter to and from its destination.

6 Claims, 7 Drawing Figures

COLLAPSIBLE SELF-STORING SHELTER

SUMMARY OF THE INVENTION

This invention relates to the field of collapsible, self-storing shelters of the type used for ice fishing and camping and provides a sturdy, compact, lightweight shelter usable for a variety of recreational purposes.

The self-storing, collapsible shelter utilizes a rigid floor platform on which the remainder of the shelter is carried. The platform, which preferably is rectangular in shape with a flat floor surface, has a rear wall swingably mounted along an edge of the platform to swing between a generally upright erected position and a lowered position overlying and confronting the floor surface, the axis about which the rear wall swings being positioned parallel to and at a distance of a few inches above the floor surface for reasons to be described hereafter. A front wall is swingably mounted along the edge of the platform opposite that to which the rear wall is attached and is swingable between an upright erected position and a lowered position overlying and confronting the lowered rear wall. The axis about which the front wall rotates is parallel to and at a greater distance above the platform than that separating the rear wall axis and the platform, permitting the front wall to be lowered to an overlying position above the rear wall. A closable door is formed in one or both of these walls to facilitate entry into and exit from the shelter.

A plurality of longitudinal beams is removably mounted between the upper parts of the front and rear walls to prevent swinging of the walls toward one another, the beams being storable between the platform and the rear wall when the rear wall is in lowered position. To prevent the front and rear walls from swinging outwardly away from one another, a plurality of restraints is attached between each wall and the platform, and these restraints cooperate with the longitudinal beams to keep the front and rear walls in upright erected positions.

A flexible weather-resistant tarpaulin extends between and is fixed to the upright front and rear walls and is also fixed to the platform, the tarpaulin being supported upon the longitudinal beams to define an integral roof and sidewalls interconnecting the front and rear walls. When the front and rear walls are in lowered position, the tarpaulin stores between the front and rear walls and is protected and sheltered from the elements and from physical abuse by the overlying front wall.

A pair of lateral frame members extends longitudinally along the lines of attachment between the tarpaulin and the platform to confront the edges of the front and rear walls when these walls are in lowered positions, providing further protection to the tarpaulin when the shelter is in collapsed condition.

To facilitate transporting of the shelter, a stationary ski may be mounted along one of the edges of the platform and a second ski positioned outboard of the stationary ski to support the shelter therebetween. The second ski is mounted for swinging movement between the outboard platform supporting position supporting the shelter and a storage position closely spaced from and underlying the stationary ski.

The collapsible shelter may be used during all seasons of the year; it may be used as an ice fishing house during the winter, a base camp for hunting in the fall, a ground supported camping or sleeping enclosure or alternatively as a car-top sleeping facility for automobile campers. It is extremely useful as a collapsible deck cabin for pontoon boats or rafts. Its collapsible and lightweight nature makes it ideal for the limited deck space available on most pontoon rafts, thereby permitting the deck to be cleared for other uses when a deck cabin is unneeded. The availability of a closed cabin makes fishing substantially more pleasant and enjoyable for persons fishing from the pontoon boat during rainy and inclement weather. The invention includes a viewing conduit extending from within the shelter downwardly through the floor and raft to depths below the water surface. The darkened cabin interior permits a fisherman greatly improved visibility of sub-surface fishing grounds through the conduit and permits careful selection of fishing locations.

These and other advantages of the invention will appear from the following detailed disclosure and the appended drawings.

BRIEF DESCRIPTION OF THE DRAWNGS

DESCRIPTION OF THE PREFERRED EMBODIMENTS

Figure 1:
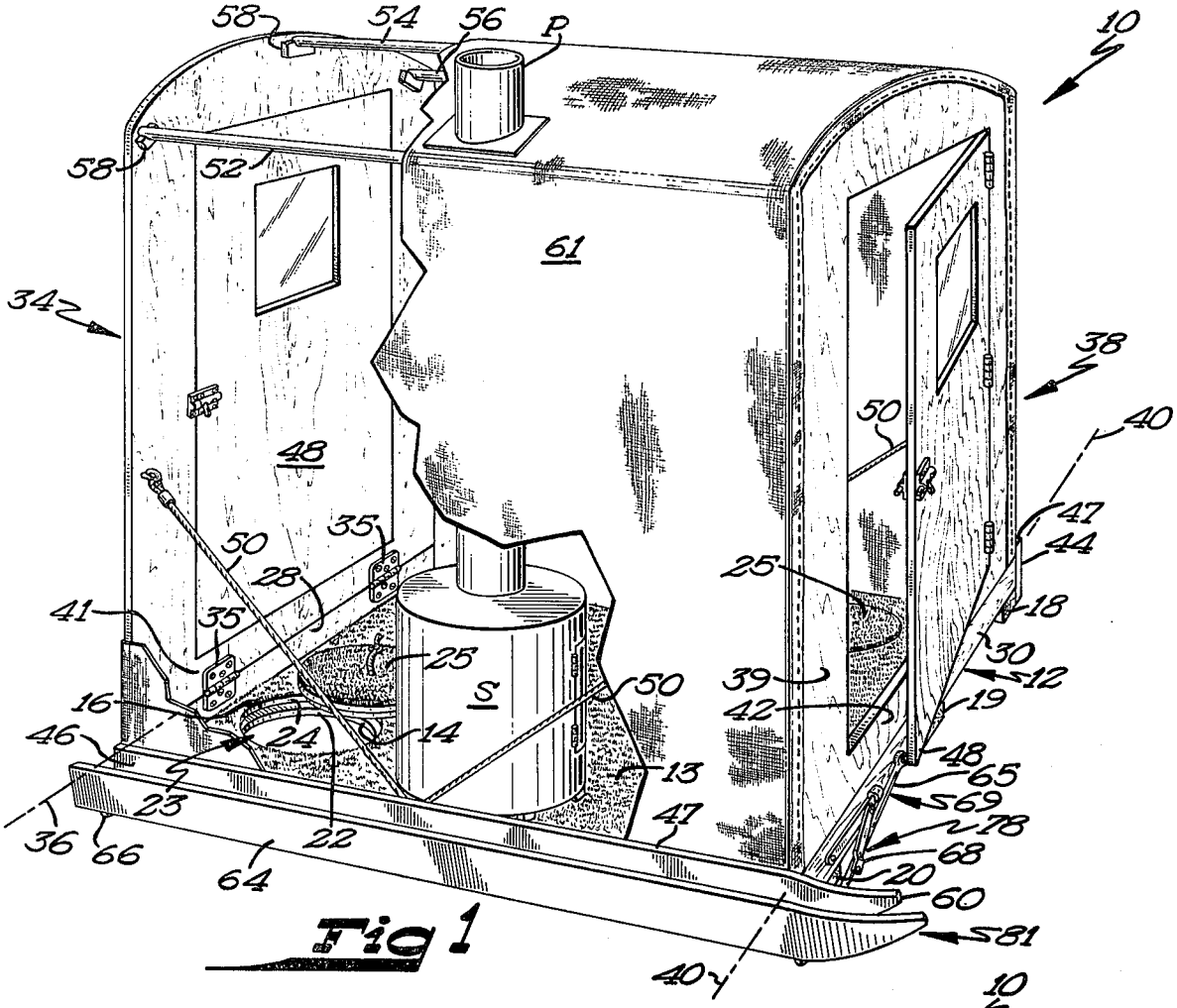
FIG. 1 is a perspective view, partly cut away, of a collapsible self-storing shelter in erected condition and embodying the invention.
Figure 2:
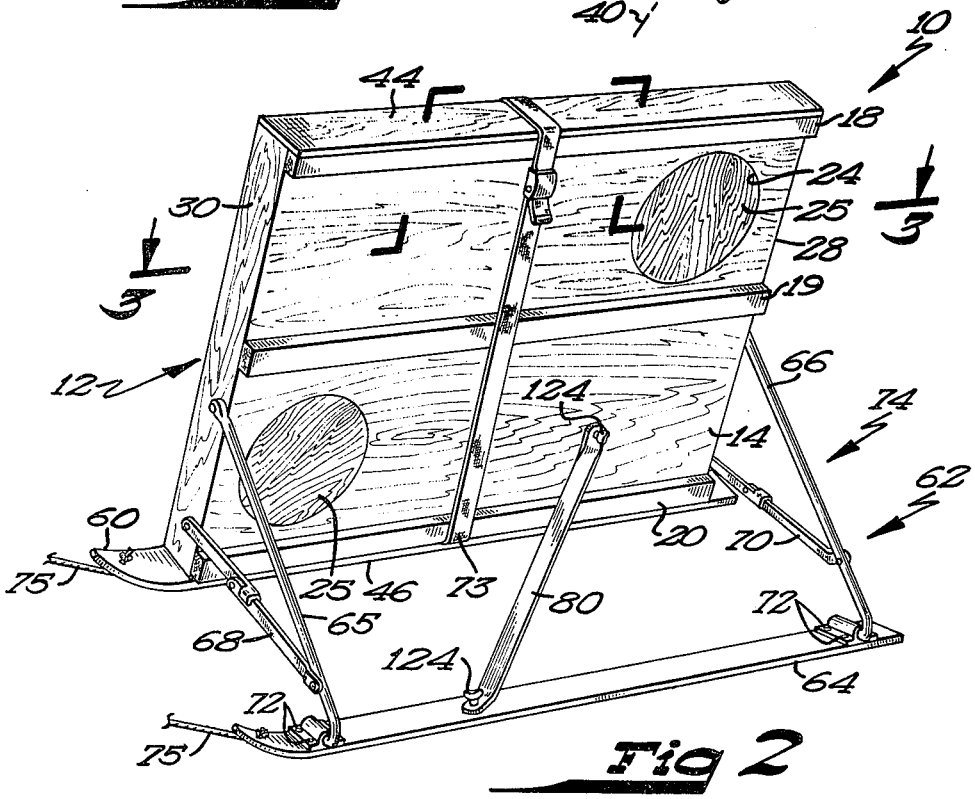
FIG. 2 is a perspective view of the self-storing shelter of FIG. 1 when in a collapsed condition showing a ski apparatus for support of the shelter during transport.
Figure 3:
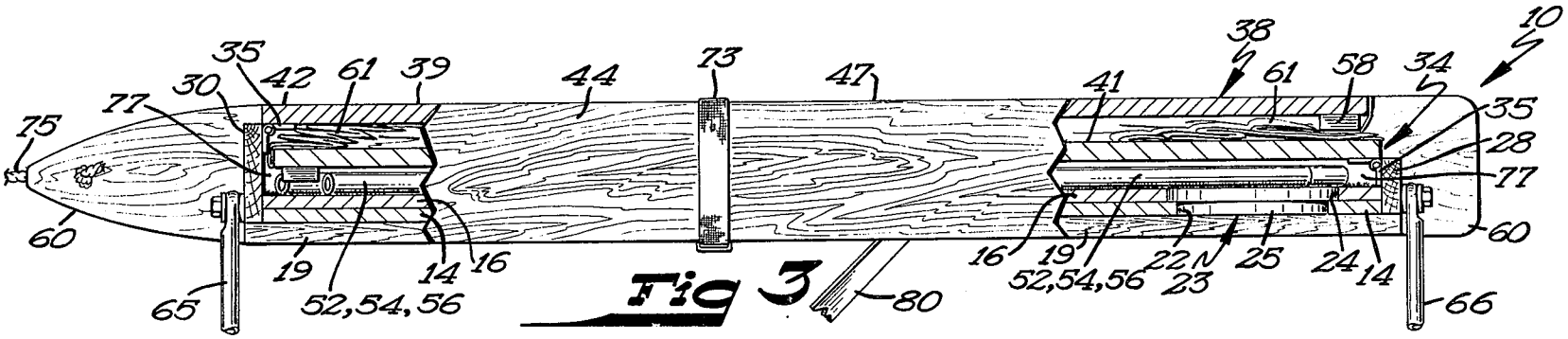
FIG. 3 is a side elevation view taken along the cutting plane 3—3 of FIG. 2 and showing the shelter when in collapsed condition.

Referring now to FIGS. 1–3, a collapsible shelter 10 embodying the invention has a rigid platform 12 with a generally flat floor surface 13. The platform 12 may be formed of any suitable material, a pair of back-to-back plywood sheets of sufficient thickness to safely support the expected load being preferred.

Referring now to FIG. 2, the shown platform 12 has lower plywood sheet 14 and upper plywood sheet 16 rigidly fixed to one another be screws, bolts, glue or other appropriate means known to the art. Substantially parallel, longitudinally extending spacers 18, 19 and 20 formed from wood or other usable material are rigidly fixed to the underside of the plywood sheet 14 to space the sheet 14 from the often wet or damp ground on which the shelter may be used.

The platform 12 may be provided with one or more openings 23 therethrough for ice fishing by its occupants. To form such openings, it is preferred that the lower sheet of plywood 14 be provided with an opening 22 of a first diameter and the upper sheet 16 be provided with a communicating aperture 24 of slightly larger diameter to permit a door or lid 25 to be used to close the upper aperture 24, the lid supported on the rim provided by the smaller aperture 22 of the lower sheet of plywood 14, as best shown in FIG. 3. A larger aperture may be provided for spearing of fish if desired.

A rear wall 34 has its base 41 swingably mounted to a first riser 28 which is rigidly fixed to the floor 13 of platform 12. The end or rear wall 34 is swingably mounted to the riser 28 by any means known to the art, such as the shown hinges 35 permitting the wall 34 to rotate about a first axis 36, the axis 36 being positioned a first distance above the floor 13 determined by the vertical height of the riser 28.

Front wall 38 has its base 42 swingably mounted to a second riser 30 by means of hinges or the like as already explained in conjunction with the mounting of rear wall 34. The riser 30 is fixed to platform 12 in any known manner and the vertical height of the riser 30 should be greater than that of the first riser 28 so that the axis 40 about which the front wall 38 rotates is at a greater distance above the floor 13 than is the axis 36. This positioning permits the endwall 38 to swing downwardly toward the platform 12, closely overlying and confronting the rear wall 34 when the shelter is being converted to a collapsed condition. At lateral sides of the platform 12, the lateral frame members 44 and 46 extend longitudinally the length of the platform and are fixed to the end of risers 28 and 30. Each of the lateral frame members extends upward above the floor level 13 so that the uppermost edges 47 are virtually flush with the face 39 of the front wall 38 when it is in a lowered position, thereby protecting the edges of the lowered front and rear walls when they are between the lateral frame members 44 and 46. Preferably the lateral frame members 44 and 46 are formed of wood, but equivalent materials may be used and are within the purview of the invention. The upper and lower plywood sheets 14 and 16, the first and second risers 28 and 30, and lateral frame members 44 and 46 collectively constitute one type of platform 12 usable with the invention as a foundation for the shelter 10.

The front and rear walls 34 and 38 are substantially identical, as shown in FIG. 1, and may be formed of a sheet of plywood and either or both walls provided with a swingably mounted door 48 to provide an entryway into the shelter. The generally arched or U-shaped front and rear walls are shown in generally vertical, upright erected positions in FIG. 1 but are swingable to the lowered storage positions illustrated in FIG. 3 wherein the rear wall 48 is in a position overlying and confronting the floor 13 and well below the level of the upper surfaces 47 of lateral frame members 44 and 46. The front wall 48, when placed in lowered storage position overlies and confronts the rear wall 48 and cooperates with the lateral frame members 44 and 46 to protect the interior elements of the shelter from weather and physical abuse.

To prevent the front and rear walls from swinging outwardly beyond the upright erected positions shown in FIG. 1, a pair of cords or cables 50 extends angularly between the rear wall 34 and the floor 13 and between the front wall 38 and the floor, the cables 50 being substantially taut and relatively unyielding when the walls are in erected positions. Each of the cables 50 provides a restraint which permits the endwalls to be swung from lowered positions to erected positions but prevents further swinging of the walls beyond erected positions. Although cables are shown herein, it should be understood that rods or other types of restraint may be used in place of the cables and are within the purview of the invention, but it is preferred to use a cord or cable because the flexible nature of such restraints makes them easily storable within the confines of the platform when the front and rear walls are swung into storage positions.

Longitudinal beams 52, 54 and 56 are generally parallel and extend horizontally between the upper portions of front wall 38 and rear wall 34 to prevent the front and rear walls from swinging inwardly toward one another, and cooperate with the already described restraints to retain the endwalls in erected positions. The ends of the beams 52, 54 and 56 are supported by brackets 58 which are fixed to the front and rear end walls 34 and 38, the brackets 58 being constructed so that the beams 52, 54 and 56 are removably received and retained in the brackets. Accordingly, the shown bracket construction permits the occupants of the shelter 10 to easily remove the horizontal beams from the brackets when the shelter is to be collapsed and to reinsert the beams in the shown brackets when the shelter is to be erected.

A foldable, flexible, weather-resistant tarpaulin 61 made of canvas, plastic, nylon or equivalent material extends between the front and rear walls 38 and 34, respectively, and is fixed to the edges of the walls in any known manner, as by gluing, nailing, stapling or the like. The lower edges of the tarpaulin 61 are fixed to the floor 13 of the platform 12 so the tarpaulin collectively forms an integral roof and side walls for the shelter 10 when the front and rear walls 28 and 34 are in erected positions. Preferably, the tarpaulin material selected should be flame resistant to reduce the likelihood of fire, and it is desirable that the material also be relatively flexible and easily managed in even sub-zero temperatures when the collapsible shelter 10 is to be used for ice fishing in the winter months. If desired, a stove S may be installed within the shelter 10 and an orifice provided in the roof to receive the pipe P. Installation of such a heating device makes the shelter reasonably comfortable for ice fishing and other winter sports activity even in the coldest weather.

Skis are provided to transport collapsed shelter 10 across a frozen lake or field. The lateral frame member 44 may also be a fixed or stationary ski 60, as shown in FIG. 2, to provide support for the platform 12 when the platform is in the on-edge position shown in FIG. 2.

A movable ski assembly 62 comprises second ski 64, swinging arms 64 and 66 which are pivotally mounted to the platform 12 on risers 30 and 28, respectively, and folding braces 68 and 70 which are pivotally mounted to and extend between risers 30 and arm 65 and between riser 28 and arm 66. The ski 64 is rigidly mounted to the arms 65 and 66 by screws 72 or the like, as best shown in FIG. 2. When the movable ski assembly 62 is in the shown supporting position 74 of FIG. 2 it cooperates with the stationary ski 60 to support the collapsed shelter therebetween and substantially increases the ease with which the shelter may be transported. A tow rope 75 is connected to the tips of the skis 60 and 64 for towing. A rigid strut 80 extends between the ski 64 and the lower panel 14 and is removably mounted to both by means of removable pins 124. The strut extends rearwardly from the platform, being sharply angled relative thereto and to the ski. This positioning reinforces the ski and reduces rearward dragging of the ski or bending of the arms 65 and 66 during towing, insuring that the arms 65 and 66 remain in planes substantially perpendicular to the platform during towing.

When the skis are unneeded, the movable ski assembly 62 may be folded away by bending the braces 68 and 70 upwardly and swinging the arms 65 and 66 toward the platform 12 to the ski storage position 81 shown in FIG. 1, where the storage position of the arm 65 is identified as 76 and the storage position of the brade 68 as 78. When in storage position, the movable ski 64 underlies and is closely adjacent the stationary ski 60, and accordingly is out of the way but always available for use when needed.

In operation, when the erected shelter 10 of FIG. 1 is to be collapsed and stored or transported, the operator first removes the three horizontal longitudinal beams 52, 54 and 56 by slipping them from their brackets 58 and then places the three beams on the floor 13 of the shelter, as is best shown in FIG. 2 where the beams are shown stored in compartment 77 above the floor 13. The operator then from within the shelter 10 pulls the rear wall 34 inwardly, swinging it about axis 36 downwardly toward the floor 13 of the shelter until it rests firmly on top of the already placed beams 52, 54 and 56 to define the upper surface of compartment 77. As the wall 34 is lowered, the cords 50 are arranged beneath it by the operator so as to lie between the lateral frame members 44 and 46 as the rear wall 34 is lowered, the cords 50 are arranged beneath it by the operator so as to lie between the lateral frame members 44 and 46 as the rear wall 34 drops between members 44 and 46. The operator next positions the tarpaulin 61 extending between the lowered wall 34 and the upright wall 38 into an area between the lateral frame members 44 and 46 and overlying the lowered rear wall 34; the operator now swings the front wall 38 about axis 40 downwardly to a lowered storage position overlying and confronting the tarpaulin 61 and the rear wall 34. The wall 38 provides a protective cover the tarpaulin 61 and cooperates with the lateral frame members 44 and 46 to contain the rear wall and tarpaulin therebetween, thereby protecting them from damage during transportation. A strap 73 is tightened about the platform and walls to maintain the front wall in its lowered storage position during travel. To erect the shelter, a reverse procedure is followed, wherein the front and rear walls 38 and 34, respectively, are raised to erected positions and the longitudinal beams reinserted in the brackets 58, making the shelter ready for occupancy.

Figure 4:
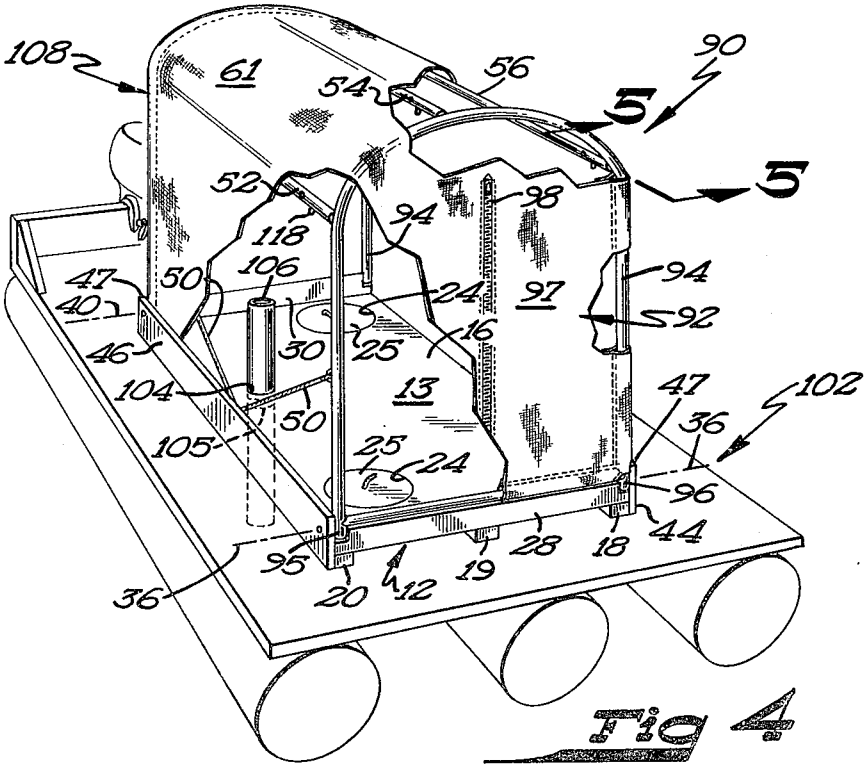
FIG. 4 is a perspective view of a second embodiment of the collapsible shelter invention attached to the deck of a pontoon boat.

Referring now to FIG. 4, a second embodiment 90 of the collapsible shelter is shown wherein a rear wall 92 has a generally U-shaped frame member 94 whose legs 95 and 96 are swingably mounted to the riser 28 in any known manner to swing about axis 36 from the upright erected position shown in FIG. 4 to the lowered storage position already described and shown as 34 in FIG. 3. The member 94 defines the outer edge of the rear wall 92 and has a weather-resistant fabric sheet 97 attached to and spread within the bowl of the U-shaped frame member 94 and also fixed to the riser 28 to define the surface of the rear wall. A zippered door 98 provides an entryway to the shelter. If desired, the remaining front wall may be constructed just as the wall 92, further reducing the weight of the shelter.

Figure 5:
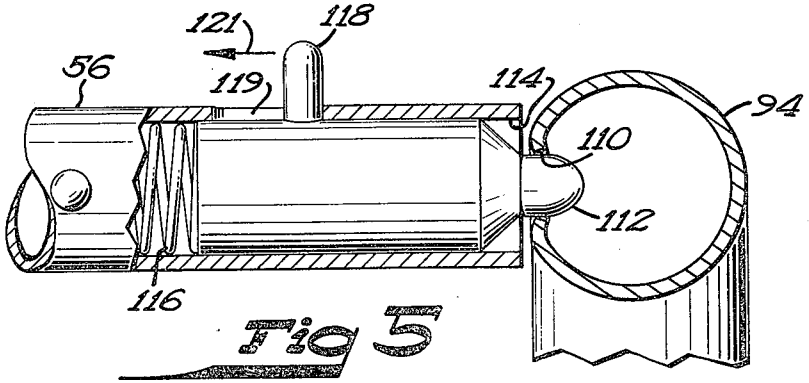
FIG. 5 is a fractional cross sectional side view taken along cutting plane 5—5 of FIG. 4 showing an end of one of the longitudinal beams used with the shelter of FIG. 4.

The longitudinal beams 52, 54 and 56 are removably mounted to the U-shaped pole 94 by any known means, such as, by way of example, the attachment means shown in FIG. 5. Referring to FIG. 5, the U-shaped frame member 94 has three sockets of the type shown at 110, shaped to receive spring-loaded peg 112 which is slideably mounted in longitudinal bore 114 at the end of the beam 52. The peg 112 is spring loaded by spring 116 to remain in the out position of FIG. 5, and a handle 118 extending outwardly through slot 119 controls the traveling distance of the peg. Each of the beams of FIG. 4 is provided with the attachment means of FIG. 5 at both ends of the beam. Accordingly the attachment apparatus of FIG. 5 removably attaches the longitudinal beams between the erected endwalls. To remove the beams an operator merely slides handle 118 in direction 121 to extract the end of peg 112 from socket 110 and the beam detaches from the U-shaped frame member 94. If both endwalls of the shelter utilize a U-shaped frame member the attachment means of FIG. 5 is used on each end of the longitudinal beams. If only the rear wall has the member 94, the ends of the beams mounted to the front wall may be attached as shown in FIG. 1 or the front wall may be provided with sockets in the plywood sheet to receive a peg 112 like that shown in FIG. 5. It should be understood that the attachment means shown in FIG. 5 is but one type of attachment means usable with the invention and that other devices known to or obvious to one skilled in the art are within the purview of the invention. When the horizontal beams 52, 54 and 56 are removed, the rear wall 92 folds inwardly onto the floor 13 of the shelter 90 just as already described in conjunction with wall 34 of the embodiment 10. Restraints 50 prevent overtravel of the rear wall 92 in an outward direction from the shelter 90.

It has been found particularly desirable to use the lighter, canvas construction, soft rear wall 92 when a lightweight shelter is desired, and the canvas endwall construction of FIG. 4 may be used at one or both ends of the shelter 90. The use of a soft endwall construction is particularly desirable when the shelter 90 is to be mounted on a pontoon boat 102 or like flotation device such as shown in FIG. 4.

In the embodiment 90 of FIG. 4, an aperture 104 is formed in the floor 13 and communicates with an aperture 105 in the deck of the raft 102. An open-ended conduit 106 is passed through the communicating apertures 104 and 105, extending from within the shelter to beneath the water level to thereby permit a viewer within the shelter 90 to comfortably observe the lake bottom for preferred fishing grounds while the surrounding shelter blocks ambient light which would otherwise interfere with such viewing.

It has been found particularly desirable to use the collapsible shelter on a pontoon craft because the shelter provides substantially greater comfort for fishermen during inclement weather while retaining the versatility of an open-decked craft because the shelter is easily collapsible and when collapsed occupies little space on the deck of the craft. To collapse the shelter 90 of FIG. 4, the conduit 106 is first removed from the openings 105 and 104 and the horizontal beams 52, 54 and 56 then removed as was the case for the shelter 10. The remaining steps to collapse the shelter 90 are identical to those already described in conjunction with the shelter 10 and will not be repeated. It has been found particularly desirable to use a soft canvas type rear wall with the boat-supported shelter in order to decrease weight. The front endwall 108 may also be of a canvas construction substantially the same as the endwall 92. Alternatively the endwall 108 may be formed of a plywood material like that shown as 38 in FIG. 1 to thereby obtain a protective cover for the collapsed shelter, permitting users of the craft to walk freely upon or place any type of cargo on top of the collapsed shelter without damage to the tarpaulin or walls of the shelter 90.

The shelter 10 or 90 may be formed of any reasonable size and the vertical height may be greater or lesser than shown in the drawings, and all such modifications and variations are within the purvew of the invention.

Figure 6:
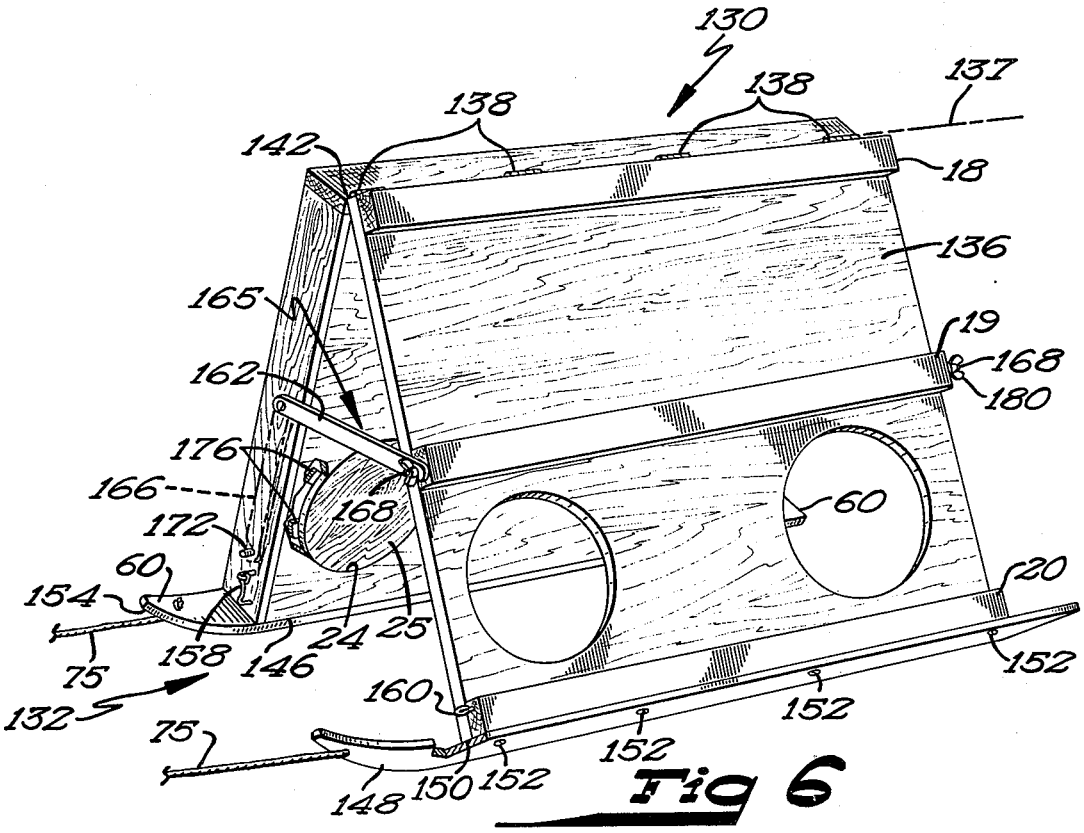
FIG. 6 is a perspective view of a third embodiment of the invention having a movable ski shown in extended position.
Figure 7:
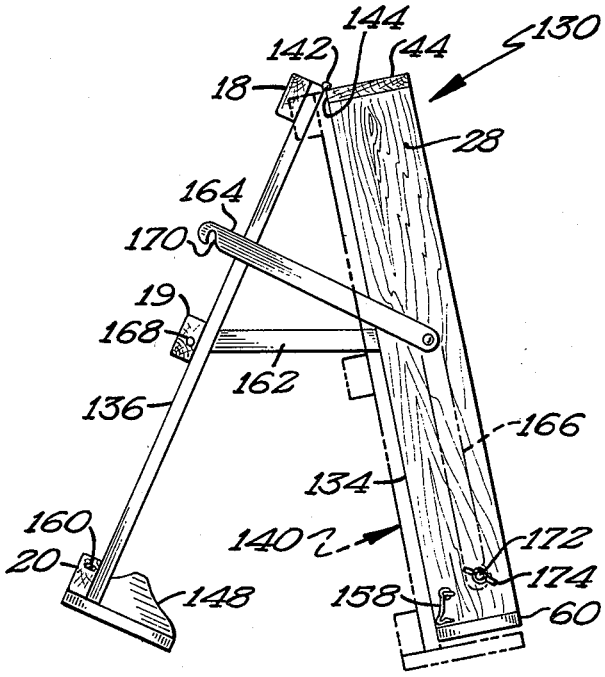
FIG. 7 is an end view of the embodiment of FIG. 6 and taken in the direction of arrows 7—7 showing the extended and storage positions of the movable ski.

Referring now to FIGS. 6 and 7, a third embodiment 130 of the invention has a platform 132 with a generally rectangular upper panel 134 and lower panel 136 formed of wood paneling such as plywood. The upper panel 134 corresponds substantially to the upper panel 16 already described and discussed in conjunction with the embodiments of the invention shown in FIGS. 1–5.

The lower panel 136 has first and second parallel edges 142 and 150, respectively, and edge 142 is swingably mounted to a first edge 144 of upper panel 134 by means of a plurality of hinges 138 or the equivalent, permitting panel 136 to be swung about axis 137. The shown hinges 138 are sunk into the surface of the panels 134 and 136 so as to have the outer surfaces of the hinges flush with the panels to which they are mounted and permit the panels to be swung flushly against one another in confronting relationship as best shown in FIG. 7 where the lower panel 136 is in storage position 140. Risers 18, 19 and 20 are rigidly fixed to the lower surface of the lower panel 136 in any known manner and reinforce the panel, spacing it from ground level as already described for shelter 10 of FIGS. 1 and 2. The riser 18 is positioned along an edge 142 of the panel 136, providing reinforcement into which the screws retaining hinges 138 may be driven for secure mounting.

A first ski 60 is rigidly fixed to the platform 132 in any known manner and extends along the edge 146 which is parallel to the edge 144. The ski 60 is identical to the ski already described in conjunction with the embodiment 10 shown in FIG. 2.

A second ski 148 extends along and is rigidly fixed to the edge 150 of the lower panel 136 in any known manner such as by screws 152 driven into the riser 20.

The width of the panel 136 as measured between the edges 142 and 150 is slightly greater than the distance between the surface of member 44 and the lower surface 154 of the ski 60 to permit second ski 148 to closely underlie the ski 60 when in the storage position 140. When in the storage position 140 of FIG. 7, a hook 158 on member 30 and eye 160 on panel 136 cooperate to retain the panel 136 in storage position.

A pair of braces 162 and 164 are swingably mounted or pivoted to members 30 and 28, respectively, for swinging movement between the operating position 165 and the storage position 166. When in the operating position 165, each of the braces 162 and 164, which collectively constitute brace means, fits securely over an extending peg 168 which may be attached either to the panel 136 or riser 19 and extends outwardly and engages the notch 170 in each brace. A wing nut 178 may be tightened on the rods 170 to keep the braces in operating positions. When unneeded, the braces 162 and 164 are swung downwardly to the storage positions 166 in which the notch 170 fits about bolt 172 and is rigidly retained against the member 30 or 28 by means of a wing nut 174.

In order to prevent the lids 25 from dropping through the opening 24, a plurality of outwardly extending ears 176 are attached to the periphery of the lid 25 and rest on the rim of the opening 24 within the shelter 10, effectively containing them within the shelter and preventing their loss when the shelter is being towed in the orientation shown in FIG. 6.

It should be understood that the embodiment of the invention disclosed in FIGS. 6 and 7 has the same front and rear walls, interconnecting tarpaulin, and the like which characterize the embodiment in FIGS. 1–5 and accordingly the shelter is erected and taken down in the same manner already described.

When an operator desired to transport the shelter shown in FIGS. 6 and 7 from place to place, he collapses the shelter as already described for the embodiments of FIGS. 1–5 and raises the platform to the substantially upright position shown in FIG. 7. He then removes the hook 158 from eye 160 at one or both ends of the platform and swings the lower panel 136 about hinges 138 outwardly away from the upper panel 134 from storage position 140 to the outriding position 178 shown in FIG. 7. He then loosens the wing nuts 174 and swings the braces 164 and 162 outwardly and upwardly, dropping the notches 170 over the extending pegs 168 and securing them in operating position 165 with wing nuts 180. Accordingly, the braces 162 and 164 retain the panel 136 in the outriding position and permit the entire shelter 130 to be balanced and supported upon the skis 60 and 148 and easily towed from place to place.

While the preferred embodiments of the present invention have been described, it should be understood that various changes, adaptations and modifications may be made therein without departing from the spirit of the invention and the scope of the appended claims.

What is claimed is:

1. A collapsible, self-storing shelter comprising:

a rigid, substantially horizontal platform having a generally flat floor surface;

a rear wall having a base swingably mounted to said platform to swing about a first generally horizontal axis between an upright erected position and a lowered storage position overlying and confronting said floor surface, said first axis being parallel to and at a first distance above said floor surface;

a front wall spaced longitudinally along said platform from said rear wall and having a base swingably mounted to said platform to swing about a second generally horizontal axis between an upright erected position and a lowered storage position overlying and confronting said rear wall when said rear wall is in lowered position, said second axis being parallel to said first and at a second distance above said floor surface exceeding said first distance;

a plurality of cables extending between said platform and each of said front and rear walls, permitting said walls to be swung from lowered storage positions to erected positions and preventing further swinging of said walls beyond erected positions;

a plurality of longitudinal beams removably attached to each of said front and rear walls and extending therebetween, and preventing swinging of said front and rear walls toward one another when attached thereto, said beams cooperating with said cables to retain said walls in erected positions; and a foldable, flexible, weather-resistant tarpaulin extending between and fixed to said front and rear walls and fixed to said platform, said tarpaulin being supported upon said plurality of beams to form an integral roof and side walls when said front and rear walls are in erected positions and foldably stored and confined between said front and rear walls when said front and rear walls are in lowered positions; and one of said walls having a closable entryway therein to permit entry into the shelter.

2. The collapsible shelter of claim 1 wherein:

said platform further includes a first ski extending along and fixed to an edge of said platform so that when said shelter is collapsed and said platform is in an on-edge position it is supported on said first ski; and a movable ski assembly comprises:

a second ski;

a pair of rigid arms, an arm attached adjacent each end of said second ski and extending to and swingably mounted to said platform to permit swinging said second ski from a storage position underlying and closely spaced from said first ski to a platform supporting position spaced laterally outwardly from said platform wherein said second ski cooperates with said first ski to support said platform in an upright position between said skis; and a pair of braces extending between said platform and each of said arms to selectively retain said arms in said platform supporting position.

3. The collapsible shelter of claim 1 wherein said platform further includes a pair of lateral frame members spaced apart at a fixed distance fron one another extending longitudinally along the lines of attachment between said tarpaulin and said platform, said tarpaulin being between said members and said members confronting the edges of said front and rear walls when said walls are in lowered positions to confine said tarpaulin between said frame members and prevent damage to the tarpaulin when the shelter is in a collapsed condition.

4. The collapsible shelter of claim 3 wherein said platform is rectangular and further includes a first riser attached thereto and extending along an edge thereof and perpendicular to a said lateral member, said rear wall being swingably mounted to said first riser in order to space said first axis said first distance from said floor surface and to protect said tarpaulin when the shelter is in collapsed condition, said platform further including a second riser attached to said platform and extending along the edge opposite that along which said first riser is attached, said front wall being swingably mounted to said second riser in order to space said second axis said second distance from said floor surface and to further protect said tarpaulin when the shelter is in collapsed condition, said first riser defining the height of a compartment above said floor surface and beneath said rear wall in which said plurality of beams are stored when said shelter is in a collapsed condition, and said lateral frame members, said first and second risers and said front and rear walls cooperating to confine said tarpaulin therebetween when the shelter is in collapsed condition.

5. The collapsible shelter of claim 1 and further including:

a flotation device to support said platform on a body of water and said platform being attached to said flotation device;

said platform and flotation device having communicating apertures therethrough confronting the surface of the body of water; and an open-ended conduit mounted on said platform and extending from within said shelter and passing through said communicating apertures and beneath the surface of the body of water to permit an observer within said shelter to see downwardly through said conduit and beneath the surface of the body of water to locate fishing grounds and the like, said tarpaulin and front and rear walls of said shelter obstructing the entry of ambient light into the shelter to substantially improve underwater visibility for an observer within the shelter.

6. The collapsible self-storing shelter of claim 1 wherein:

said platform includes upper and lower panels, each panel having first and second parallel edges, said first edge of said lower panel being swingably mounted to said first edge of said upper panel so said lower panel may swing about an axis from a storage position wherein said panels confront one another and are substantially flush with one another to an outriding position wherein said lower panel is swung outwardly from said upper panel;

said platform further including a first ski extending along and fixed relative to the second edge of said upper panel;

a second ski extending along and fixed to the second edge of said lower panel; and brace means extending between said lower panel and the remainder of said platform to selectively retain said lower panel in outriding position and permit said shelter to be supported and carried upon said first and second skis.

* * * * *

UNITED STATES PATENT AND TRADEMARK OFFICE

CERTIFICATE OF CORRECTION

PATENT NO. : 3,971,395

DATED : July 27, 1976

INVENTOR(S) : Vincent B. Lipinski

It is certified that error appears in the above-identified patent and that said Letters Patent are hereby corrected as shown below:

Col. 2, Line 56: Delete "be" and substitute --by--.

Col. 4, Line 32: Delete "28" and substitute --38--.

Col. 5, Lines 28-31: After "rear wall 34" delete --is lowered, the cords 50 are arranged beneath it by the operator so as to lie between the lateral frame members 44 and 46 as the rear wall 34--.

Col. 8, Line 14: Delete "desired" and substitute --desires--.

Col. 8, Line 55: After "first" insert --axis--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*